United States Patent [19]

Grenn

[11] Patent Number: 4,508,246

[45] Date of Patent: Apr. 2, 1985

[54] CHECK MEANS FOR A WATER DISPENSER

[76] Inventor: James F. Grenn, Rte. 2, Box 169, Bogue Chitto, Miss. 39629

[21] Appl. No.: 533,767

[22] Filed: Sep. 19, 1983

[51] Int. Cl.[3] ..... B65D 47/00

[52] U.S. Cl. ..... 222/477; 141/364

[58] Field of Search ..... 222/67, 129, 166, 450, 222/181, 185, 463, 476, 477, 501, 541, 544, 545; 137/513.5; 141/363–366, 319–321, 351, 311 R, 311 A

[56] References Cited

U.S. PATENT DOCUMENTS

| | | | |
|---|---|---|---|
| 991,568 | 5/1911 | Walter | 222/185 X |
| 1,538,483 | 5/1925 | Grantham | 222/476 X |
| 2,943,797 | 7/1960 | Moro-Lin | 222/212 X |
| 3,042,272 | 7/1962 | Anderson | 222/542 X |
| 3,229,854 | 1/1966 | Turnquist | 222/450 X |
| 4,310,038 | 1/1982 | Yule | 222/477 X |

*Primary Examiner*—Joseph J. Rolla
*Assistant Examiner*—Kevin P. Shaver
*Attorney, Agent, or Firm*—Walker & McKenzie

[57] ABSTRACT

A check for use with an invertible water bottle and a water dispenser. The check includes a cap member for secure attachment to the mouth of the water bottle, the cap member having an aperture therethrough to allow water to freely pass therethrough when the bottle is inverted; and includes a float for momentarily closing the aperture in the cap member when the bottle is first inverted.

9 Claims, 10 Drawing Figures

CHECK MEANS FOR A WATER DISPENSER

BACKGROUND OF THE INVENTION

1. Field of the Invention

The present invention relates to check valves for the inverted bottle-type water dispensers.

2. Description of the Prior Art

Various devices have been developed that relate to invertible containers and dispensing devices and the like. See, for example, the following U.S. Pat. Nos. 1,248,705 (Pogue); 939,594 (Fulper); 1,501,068 (Schatz); 4,310,038 (Yule); 1,694,925 (Morrison); 2,679,140 (Burchett). None of the above patents disclose or suggest the present invention.

SUMMARY OF THE INVENTION

The concept of the present invention is to provide a sanitary way of eliminating or reducing the spillage of water while inverting the water bottle that is used in an invertible type water cooler and dispenser. Previously, the typical manner in which such spillage was avoided was to place a hand over the aperture and neck of the bottle as it was inverted to be placed on the dispenser, thus spreading dirt and germs into the water system. The present invention is an improvement over the prior art.

The present invention comprises a check means that is easily secured on the neck of the water bottle covering the aperture in such a way as to restrict the flow of water from the bottle during the time required to invert the bottle and place it in the water cooler and dispenser.

The check means comprises, in general, a cap member for being secured to the mouth of the bottle, the cap member having an aperture therethrough for allowing water to pass therethrough when the bottle is inverted; and a float means for momentarily restricting the flow of water as the bottle is inverted and placed in the water cooler or dispenser.

DESCRIPTION OF THE PREFERRED EMBODIMENT

Figure 1:
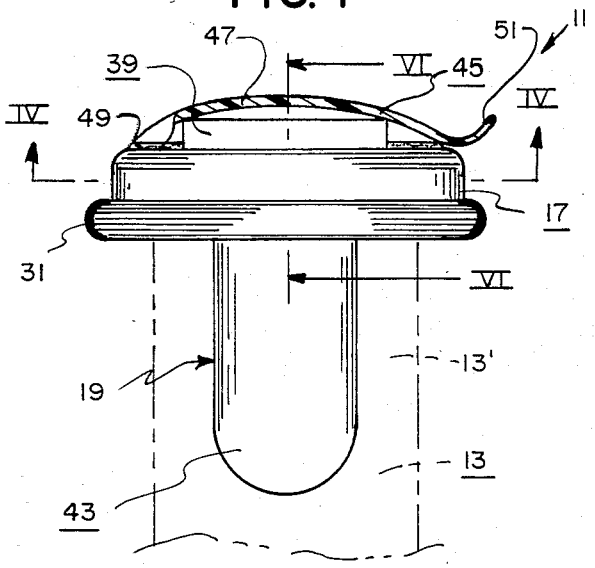
FIG. 1 is a front elevational view of the check means of the present invention with portions thereof broken away and showing the water bottle neck in phantom lines.

The check means 11 of the present invention provides a means for momentarily restricting or stopping the flow of water from a water bottle 13 as the bottle 13 is inverted and installed on a water dispenser 15, thus eliminating or reducing the spillage thereof.

The check means 11 of the present invention comprises, in general, a cap member or means 17 for being secured to the neck 13' of the water bottle 13, a float means 19 for being received in the mouth or aperture 13'' in the neck of the water bottle 13 for restricting the flow of the water from the water bottle 13 as the bottle 13 is inverted and placed on the water dispenser 15.

The cap means 17 of the present invention includes a substantially circular aperture 21 therethrough for allowing the water to freely flow from the inverted bottle 13 into the dispenser 15. The substantially circular aperture 21 includes a first end 23 and a second end 25. The first end 23 may be substantially larger in diameter than the second end 25, causing a beveled portion or wall 27 to connect the first end 23 and second end 25 thereof. The cap means 17 includes a by-pass means for allowing water to trickle past the float means 19 when the bottle 13 is inverted and the float means 19 is closing the aperture 21. The by-pass means 29 may be defined by one or more openings 29 through the cap means 17. The openings 29 are preferably conterminous with the aperture 21 and may be substantially parallel with the beveled portion 27 of the aperture 21. The by-pass opening 29 is constructed in a manner apparent to those skilled in the art to allow a trickle of water to pass therethrough when the water bottle 13 is in the closed inverted position in the dispenser 15.

The cap means 17 may also include a flange member 31 (i.e., a projecting rim fixedly or integrally attached to the body of the cap means 17). The flange member 31 provides a gripping surface for one's fingers to grip and aids in the removal of the cap means 17 from an upright water bottle 13, etc.

Figure 6:
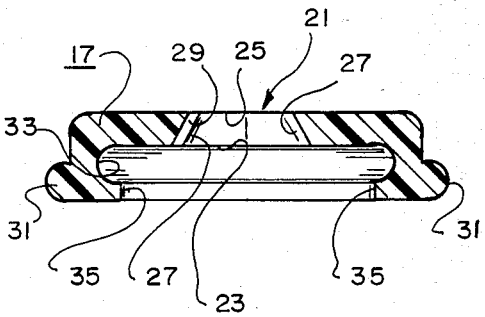
FIG. 6 is a sectional view of the cap member substantially as taken on line VI—VI of FIG. 1.
Figure 10:
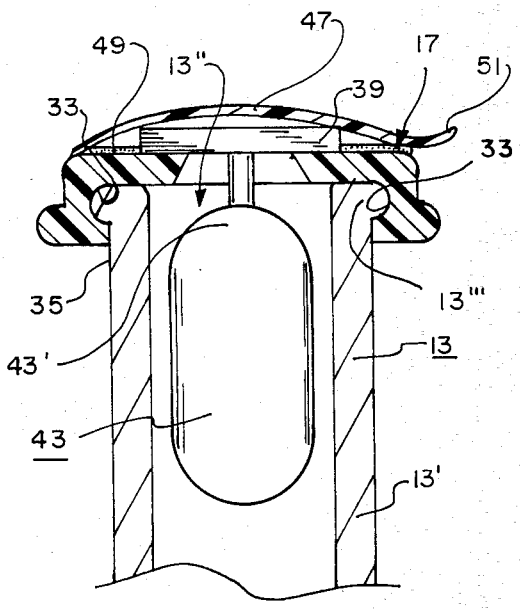
FIG. 10 is a partial sectional view of the check means on the neck of a bottle before the bottle has been inverted.

The cap means 17 may also include an undercut portion or means 33 consisting of a substantially enlarged concaved groove or area on the inside of the cap means 17 adjacent the aperture 21 (see FIG. 6) for the sealing or attachment of the cap means 17 to the lip 13''' of the water bottle 13 (see FIG. 10). The undercut portion 33 helps define a lip portion 35 (i.e., an internal protruding portion located on the inside leading edge of the cap means 17). The lip portion 35 helps to seal and hold the cap means 17 to the lip 13''' and neck 13' of the water bottle 13.

The cap means 17 may be constructed out of a plastic material in any manner now apparent to those skilled in the art, such as by a typical injection-molding process.

Figure 5:
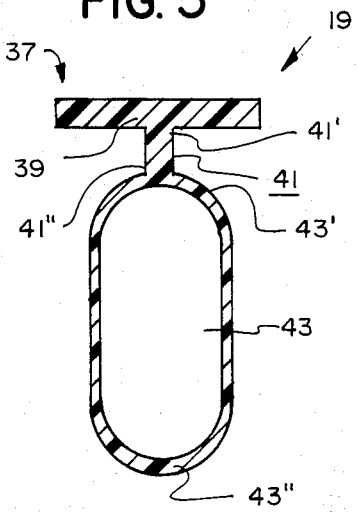
FIG. 5 is a sectional view of the float means of the present invention.
Figure 4:
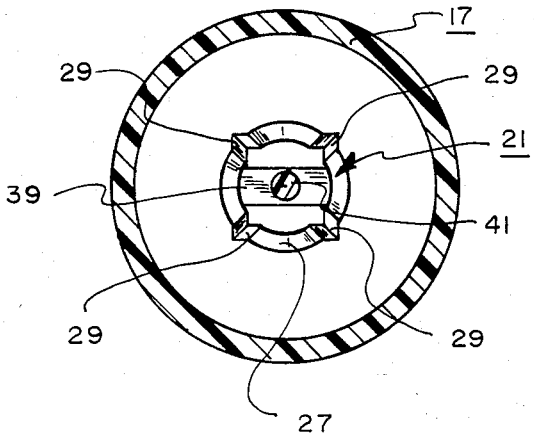
FIG. 4 is a sectional view of the cap member substantially as taken on line IV—IV of FIG. 1.

The check means 11 of the present invention may include a holding means 37 for holding the float means 19 substantially adjacent the mouth 13'' of the bottle 13 when the bottle 13 is in the upright position (see FIG. 1). The holding means 37 may include a bar member 39 extending across the aperture 21 in a manner as not to block substantially the aperture 21 of the cap means 17. The bar member 39 may consist simply of a substantially elongated plastic bar or rod of a length to extend completely across the aperture 21 and of a width so as not to block substantially the aperture 21 (see, for example, FIG. 2). The holding means 37 may also include a neck member 41 for securely joining the float means 19 and the bar member 39 to one another. The neck member 41 is preferably elongated and includes a first end 41' and a second end 41''. The first end 41' is fixedly attached substantially to the center of the bar member 39 in any manner apparent to those skilled in the art (see FIG. 5). The second end 41'' is fixedly attached to the float means 19 in any manner apparent to those skilled in the art (see FIG. 5). The elongated neck member 41 will allow the float means 19 to be spaced a substantial distance away from the aperture 21 of the cap means 17 when the bottle 13 is in the inverted position and the float means 19 is floating (shown in FIG. 9) so that the float means 19 will not then hinder the flow of liquid from the bottle 13. The holding means 37 may be constructed out of a plastic material in any manner now apparent to those skilled in the art, such as by a typical blow-molding process. The float means 19 includes a float member 43 that is buoyant with respect to the liquid in the bottle 13. The float member 43 has a first end 43' having a size and shape so as to form a substantial seal with the aperture 21 (and especially the beveled portion 27 thereof) in the cap means 17 when the float means 19 is in the position shown in FIG. 8 to prevent or hinder the flow of liquid from the bottle 13 through the aperture 21. Preferably, the float member 43 is substantially cylindrical and substantially rounded at both ends. The float member 43 is fixedly attached at the first end 43' thereof to the second end 41'' of the neck member 41 in any manner apparent to those skilled in the art. The float member 43 preferably has a hollow interior (shown in FIG. 5) thus causing the float member 43 to be buoyant in the liquid in the bottle 13. The float means 19 may be constructed out of a plastic material in any manner apparent to those skilled in the art, such as by a typical blow-molding process. It should be noted that the holding means 37 and the float means 19 are preferably integrally constructed as a one-piece plastic unit by typical blow-molding processes.

Figure 2:
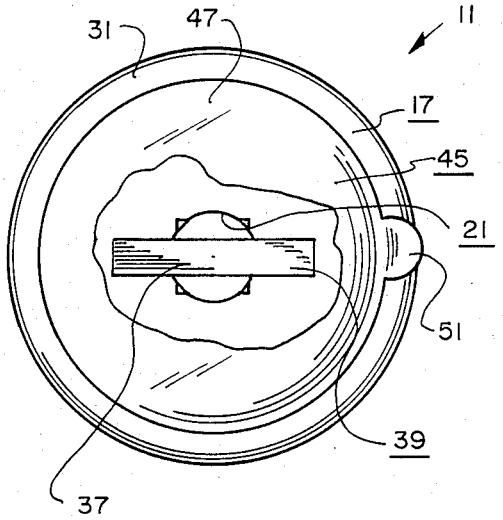
FIG. 2 is a top plan view thereof with portions thereof broken away.
Figure 3:
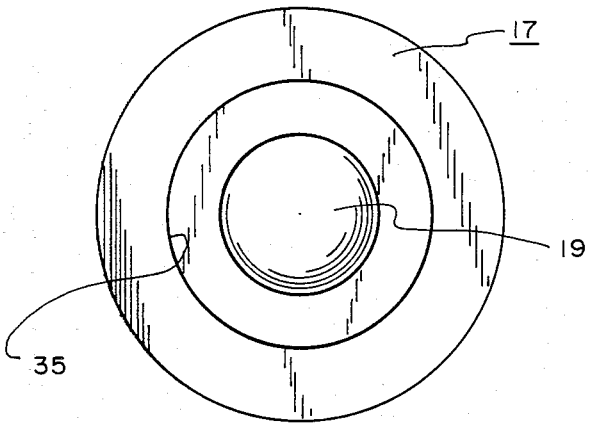
FIG. 3 is a bottom plan view thereof.

The check means 11 may include a removable seal member 45 for sealing the aperture 21 of the cap means 17 for sanitary reasons, etc. The seal member 45 may be of any typical construction now apparent to those skilled in the art. For example, the seal member 45 may include a plate-like body 47 constructed of a material such as foil, plastic or the like that will prevent or hinder the flow of liquid therethrough. The body 47 is of a shape and size to block the aperture 21 when placed thereover as indicated in FIGS. 1, 2 and 10. The seal member 45 may also include adhesive means 49 for securing the body 47 to the cap means 17. The body 47 may include a tab 51 (see, in general, FIG. 2) to allow it to be easily removed from the cap means 17.

Figure 7:
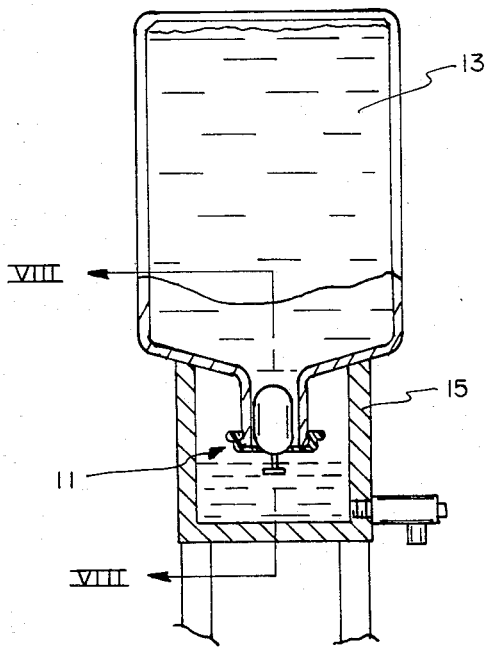
FIG. 7 is a partial sectional view of the check means of the present invention shown attached to an inverted water bottle that is placed on a water cooler-dispenser.
Figure 8:
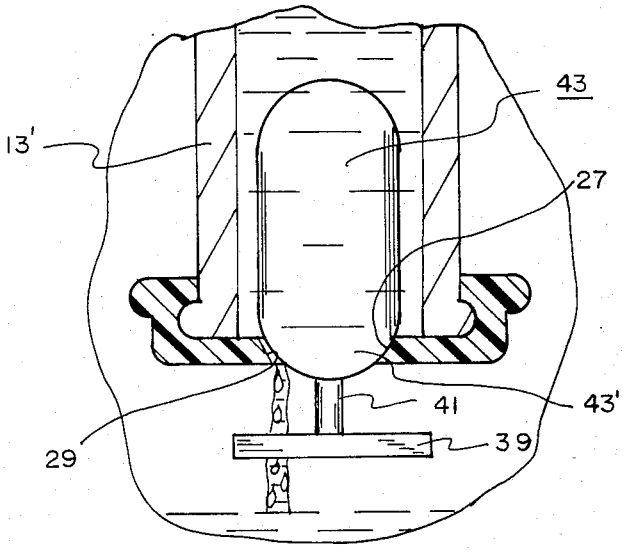
FIG. 8 is an enlarged sectional view of the check means in the closed position substantially as taken on line VIII—VIII of FIG. 7.
Figure 9:
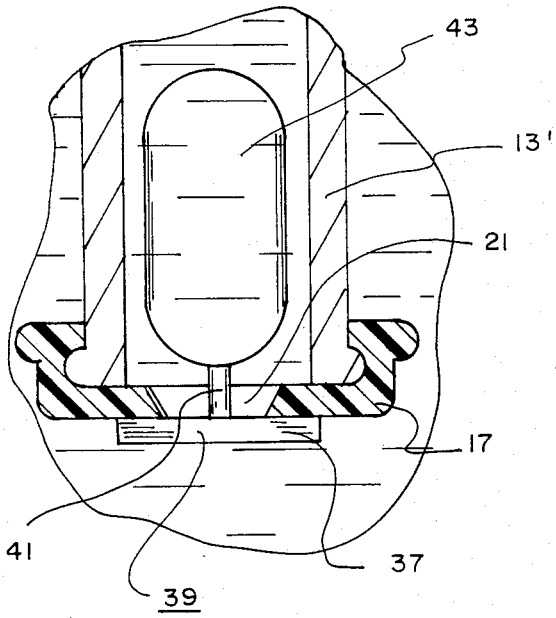
FIG. 9 is a sectional view substantially similar to FIG. 8 but showing the check means in the open position.

The operation of the check means 11 of the present invention is quite simple. The check means 11 is merely positioned over the neck 13' of the water bottle 13 with the float member 43 placed within the aperture 13'' of the bottle 13 and the cap means 17 forced down over the lip 13''' of the bottle 13 thus causing the lip 13''' of the bottle 13 to slide into the undercut means 33 of the cap 17 providing a secure attachment and seal therebetween (shown in FIG. 10). When it is desired to place the bottle 13 on the dispenser 15, the body 47 of the seal member 45 is removed from the cap means 17 and the bottle 13 is inverted to be placed on the dispenser 15 in the normal manner. As the bottle 13 is placed in the inverted position, the weight of the water forces the float member 43 into the closed position as shown in FIGS. 7 and 8. The rounded first end 43' of the float member 43 cooperates with beveled portion 27 of the aperture 21 of the cap means 17, thus causing a seal thereof. When the bottle 13 is placed in the dispenser 15, as shown in FIG. 7, the float member 43 will subsequently float away from the aperture 21 to allow the liquid to freely flow through the aperture 21 into the dispenser 15. Thus, for example, water will begin to trickle through the by-pass openings 29 of the cap means 17. As the water trickles through the by-pass opening 29, the float member 43 will move to the open position (as shown in FIG. 9), allowing the water to freely pass through the aperture 21 of the cap means 17 thus equalizing the pressure thereof. The float member 43 is held in the neck 13' of the water bottle 13 by the fixedly attached elongated neck member 41 and bar member 39 extending across the aperture 21 of the cap means 17 without blocking the aperture 21 thereof (see FIG. 2).

The opening of the check means 11 may vary due to the material the water bottle 13 is constructed of. For example, when a plastic water bottle is used, the sides of the bottle have a tendency to flex and/or pull in and thus more time is required to cause the check means 11 to open. When a glass bottle 13 is used, less time is required due to the fact that glass is rigid and the sides of the bottle will not give, thus less time is required to open the check means 11.

The present invention provides a safe and economical means of eliminating the spillage of water while changing the water bottle in a water cooler-dispenser and allows the task to be performed in a sanitary way.

Although the invention has been described and illustrated with respect to a preferred embodiment thereof, it is not to be so limited since changes and modifications can be made therein which are within the full intended scope of the invention.

I claim:

1. A check means in combination with an invertible water bottle and a water dispenser for checking any spillage of water from the mouth of the water bottle when the water bottle is inverted for placement on the water dispenser, said check means comprising:

(a) a cap member for secure attachment over the mouth of the water bottle, said cap member having an aperture therethrough for allowing the water to freely pass from the water bottle when the water bottle is inverted; and (b) float means for momentarily closing said aperture in said cap means when the water bottle is first inverted and for subsequently floating away from said aperture to allow the water to freely flow through said aperture.

2. The check means of claim 1 in which said cap member includes by-pass means for allowing the liquid from the water bottle to trickle past said float means when the water bottle is inverted and said float means is closing said aperture.

3. The check means of claim 2 in which said cap member has at least one by-pass opening therein for defining said by-pass means.

4. The check means of claim 3 in which said by-pass opening is conterminous with said aperture in said cap member.

5. The check means of claim 2 in which is included holding means for holding said float means substantially adjacent the mouth of the bottle when the bottle is in the upright position.

6. The check means of claim 5 in which said holding means includes a bar member for extending across said aperture in said cap member without blocking said aperture in said cap member, and includes a neck member for securely joining said float means and said bar member.

7. The check means of claim 6 in which said neck member is elongated for allowing said float means to be spaced substantially from said aperture in said cap means when the bottle is inverted and said float means is floating.

8. The check means of claim 7 in which is included a removable seal member for selectively sealing said aperture in said cap member.

9. The check means of claim 8 in which said float means is hollow.

* * * * *